US005333349A

United States Patent [19]

Lister

[11] Patent Number: 5,333,349

[45] Date of Patent: Aug. 2, 1994

[54] APPARATUS FOR PATCHING A BREAK IN THE SIDEWALL OF A CHIMNEY

[76] Inventor: David M. Lister, 3380 Blacklick Eastern Rd., Baltimore, Ohio 43105

[21] Appl. No.: 685,050

[22] Filed: Apr. 15, 1991

[51] Int. Cl.[5] ..... B05C 17/00

[52] U.S. Cl. ..... 15/235.8; 15/242; 15/144.1

[58] Field of Search ..... 15/235.8, 172, 244.2, 15/144 R, 144 A, 143 B, 242, 235.3, 235.4, 235.6, 235.7; 404/97; 294/3.5

[56] References Cited

U.S. PATENT DOCUMENTS

| | | | |
|---|---|---|---|
| 665,462 | 1/1901 | Peek | 15/242 |
| 765,246 | 7/1904 | McComb | 15/242 |
| 781,118 | 1/1905 | Witt | 15/242 |
| 1,327,597 | 1/1920 | Greene | 15/143 B |
| 1,416,817 | 5/1922 | Greelish | 15/143 B |
| 2,674,117 | 4/1954 | Butler . | |
| 2,817,867 | 12/1957 | Bugbird | 15/145 |
| 3,000,029 | 9/1961 | Wood | 15/172 |
| 3,090,984 | 5/1963 | Dunnigan . | |
| 3,357,035 | 12/1967 | Ficke | 15/144 R |
| 4,335,485 | 6/1982 | Paine et al. | 15/235.8 |
| 4,492,000 | 1/1985 | Skogen | 15/242 |
| 4,663,796 | 5/1987 | Helling et al. . | |
| 4,892,437 | 1/1990 | Kraft | 404/97 |
| 4,937,939 | 7/1990 | Fisher | 15/242 |
| 4,982,470 | 1/1991 | Szabo | 15/235.8 |

FOREIGN PATENT DOCUMENTS

| | | | |
|---|---|---|---|
| 0560180 | 9/1957 | Belgium | 15/144 R |
| 0362251 | 10/1922 | Fed. Rep. of Germany | 15/144 R |
| 20484 | 1/1910 | Norway | 15/144 R |
| 7403 | of 1900 | United Kingdom | 15/144 R |

*Primary Examiner*—Timothy F. Simone
*Assistant Examiner*—Tony G. Soohoo
*Attorney, Agent, or Firm*—Sidney W. Millard

[57] ABSTRACT

Patching grout is forced into a break in the sidewall of a chimney by having the repairing person deposit a quantity of grout on the upper side of a trowel and move the trowel into a position immediately below the break. The trowel is pivot-ably mounted on the end of a linear handle and the trowel is raised into position on the handle. The upper side of the trowel is tilted toward the break by a cord extending from the trowel to the worker simultaneously with the worker pushing the handle upward to thereby mash the grout against the sidewall. Thereby the grout is pushed into the break as the trowel slides upward scraping against the sidewall.

6 Claims, 2 Drawing Sheets

APPARATUS FOR PATCHING A BREAK IN THE SIDEWALL OF A CHIMNEY

FIELD OF THE INVENTION

This invention relates to an apparatus and process for patching breaks and sealing voids in remote parts of chimneys which are beyond the arm length of the normal repair person.

BACKGROUND OF THE INVENTION

Fireplaces are generally constructed of brick or stone on the exterior of a metallic fire box and the fire box is conventionally lined with fire brick. The fireplace itself is logically the most likely area for needed repairs over the years, but unfortunately it is not the only part of the fireplace - chimney combination which deteriorates over time and needs repair.

Chimneys are ordinarily constructed of masonry and lined with a specific ceramic, pumice or castable lining material in two feet sections or a monolithical cast.

Problems occur when cracks form in the chimney lining due to mortar decay, foundation settling or thermal destruction of the chimney caused from high temperatures produced from a chimney fire or simply imperfections in the lining or masonry chimney wall. For whatever reason, cracks and breaks in the lining of the chimney wall can cause problems because the cracks allow the leakage of smoke and hot gases from the chimney through the lining into areas not designed to withstand the heat and mildly corrosive atmosphere of the gaseous exhaust from the fire box.

There is no real problem in repairing the chimney lining where the worker can reach the break from below, from within the fireplace or from above while standing on the roof and leaning into the chimney. Where the break is out of reach of the repair person, to do a competent job of repair, the repair person often must dismantle the chimney itself to reach the break. As would be expected, the disassembly and reassembly of a chimney is an expensive proposition.

U.S. Pat. No. 2,674,117 illustrates a mortar spreader by a worker which has a pivotable trowel on the remote end of a handle. Grout is supported on the upper surface of the trowel. The worker stands adjacent the wall to be covered by grout as the trowel is lifted.

U.S. Pat. No. 3,090,984 discloses a smoothing trowel to be used by a worker who is smoothing plaster on the ceiling of a room. The angle of the trowel with respect to the handle supporting the same is manipulable by the worker from his location on the floor of the room by a lever and rod combination.

U.S. Pat. No. 4,663,796 discloses a trowel on the end of an elongated handle used by a worker to smooth the plaster on a ceiling while the worker stands on the floor of the room.

U.S. Pat. No. 4,492,000 discloses chimney cleaning apparatus using an elongated rod to manipulate the cleaning tool. The rod includes a plurality of segments threaded together to lengthen the rod where desirable.

There is a strong need in the industry for a process and apparatus to allow a worker to fill cracks and breaks inside a chimney with appropriate grout from a location remote from the break itself. Thereby, the chimney lining may be repaired without having to dismantle the whole chimney to accomplish the necessary repairs.

SUMMARY OF THE INVENTION

This invention solves the problem by allowing a worker to push grout (this term should be construed as including refractory mixtures) into cracks and breaks in the sidewalls of chimneys or other vertical walls where the crack or break is remote from the worker performing the repair services.

The result is achieved by providing an elongated handle having a transversely extending trowel on one end. The trowel is designed to be mounted horizontally and generally perpendicular to the axis of the handle. A quantity of grout is placed on the upper surface of the trowel and the trowel is moved into position just below the break in the masonry sidewall and then the trowel is tilted toward the sidewall as the handle is pushed upward, thereby, the grout on the upper surface of the trowel is pushed into the break in the sidewall as the trowel mashes the grout against the sidewall during its tilting and upward movement.

The trowel is pivotably mounted on the end of the handle and is spring biased to its horizontal initial position. A cord is attached to one side of the trowel and extends to the worker to allow the cord to be pulled toward the worker to tilt the trowel as needed and in particular as the worker manually raises the handle in the aforementioned procedure.

Objects of the invention not clear from the above summary will become clear upon a review of the drawings and the description of the preferred embodiment which follows.

DESCRIPTION OF THE PREFERRED EMBODIMENT

This invention is concerned with the patching of a generally vertically extending wall which is remote from the repair person, that is, beyond the arm length of the person. The apparatus and process described herein are specifically intended to be used in the confined enclosure of a chimney where a break or crack in the chimney lining is beyond the arm length of a repair person whether the person is standing on the roof reaching down into the chimney or sitting inside the fire box of a fireplace reaching upward. However, the product and process of this invention may be used with any vertical wall where it is useful. For example, it could be used to patch mortar joints outside a building by manipulating the repair apparatus through an open window or down inside a well or sewer.

Figure 1:
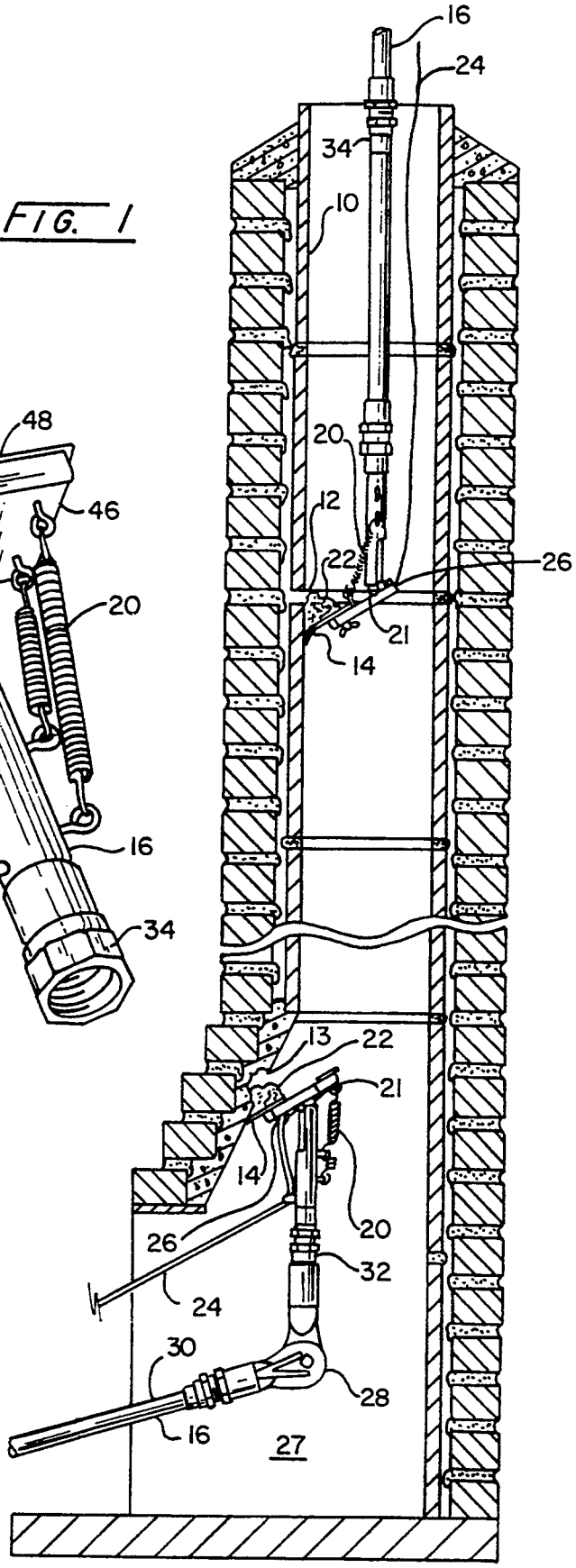
FIG. 1 is a sectional view of a chimney and fireplace having breaks in the chimney lining and illustrating a repair tool extending into the chimney from both above and below.

FIG. 1 illustrates a vertical wall 10 having a hole, crack or break 12, 13 therein which is physically remote from physical access by a repair person. In order to repair the hole by filling it with a suitable grout, apparatus is used which may be lowered from above or raised from below to carry the grout to the hole. FIG. 1 shows both techniques. Break 13 is probably not beyond the arm length of a worker but the drawing illustrates how it will work.

Figure 2:
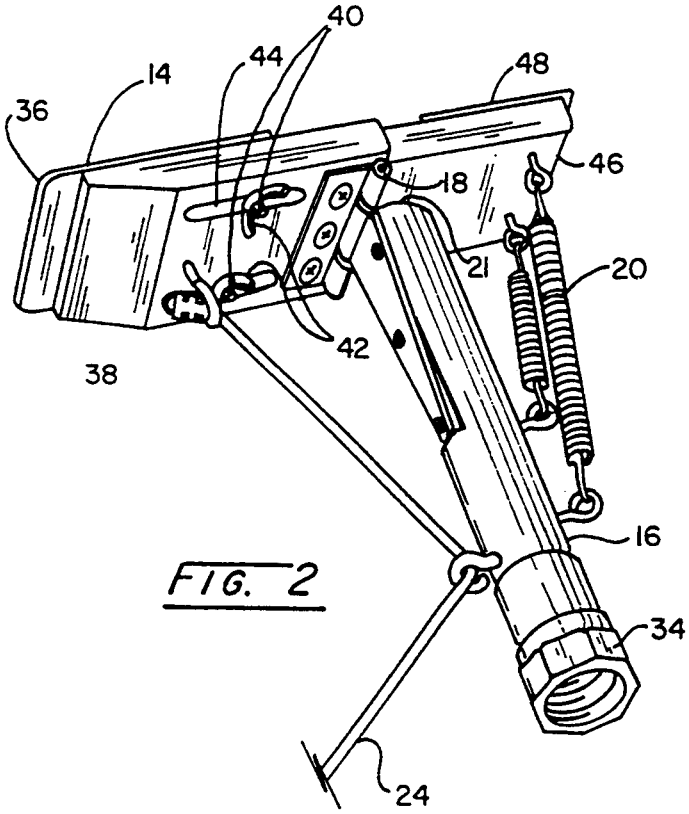
FIG. 2 is a perspective view from the bottom side of a grout spreading tool according to this invention.
Figure 4:
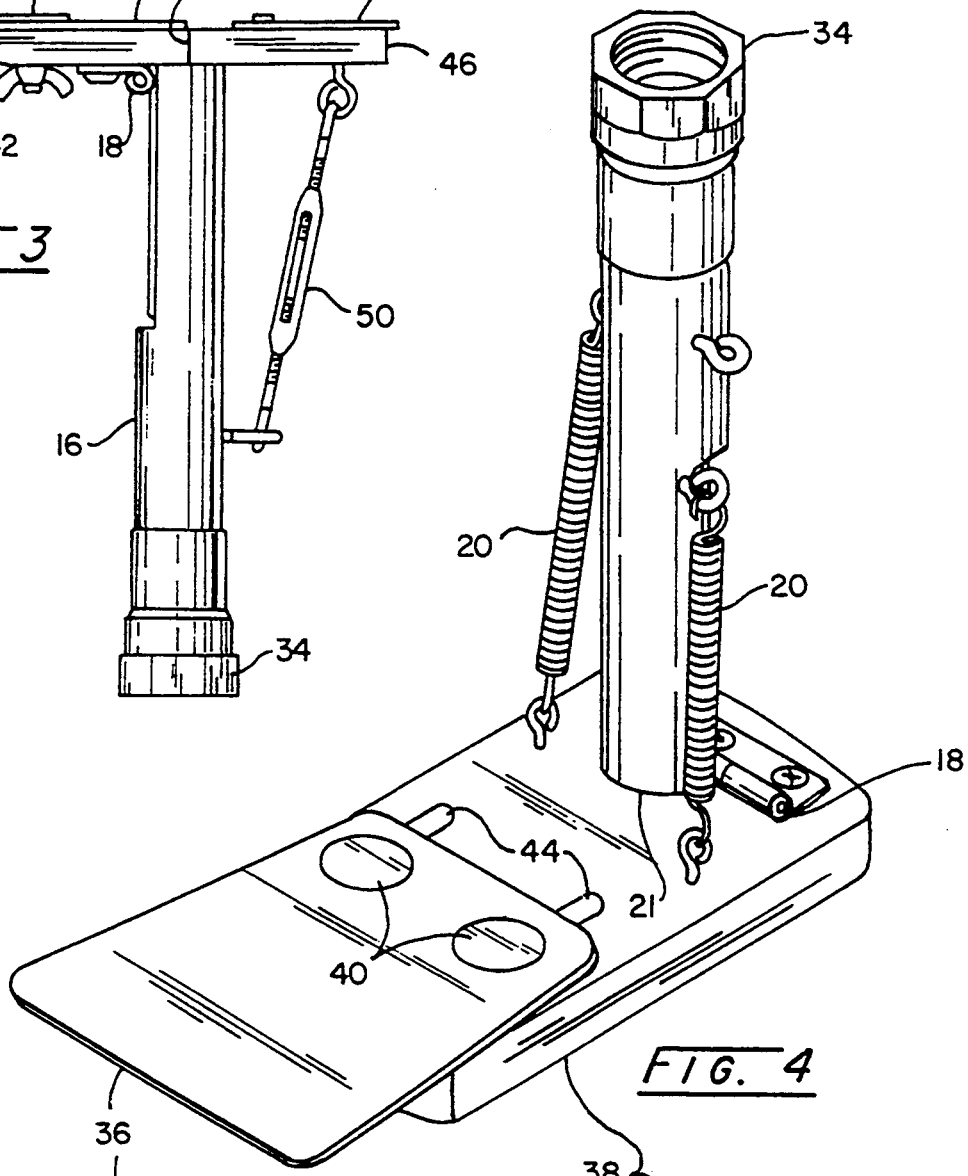
FIG. 4 is an alternative embodiment of the tool of FIG. 2.
Figure 5:
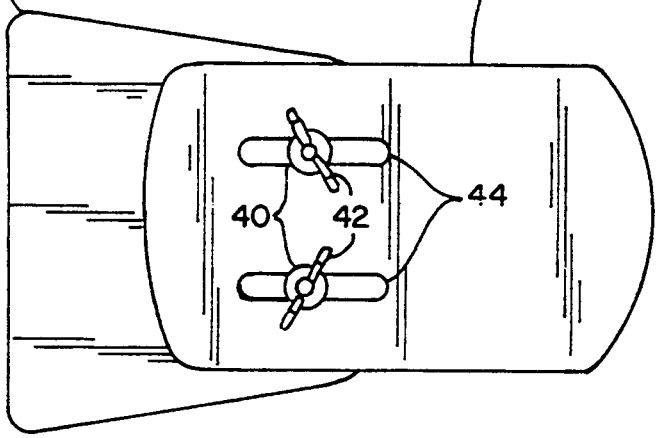
FIG. 5 is a bottom plan view of the tool of FIG. 4.

A trowel 14, best seen in FIGS. 2 and 4, is horizontally mounted on one end of an elongated and segmented wooden handle 16. The trowel is pivotally attached at 18 by a suitable hinging mechanism and is biased into position generally perpendicular to the axis of handle 16 by spring bias 20. The spring 20 pulls the trowel against a trowel engaging surface 21 which may or may not be the end of the handle such that the upper surface of the trowel is in horizontal position generally adaptable to receive a quantity of grout 22 and hold it in position against the normal forces of gravity.

A flexible cord 24 is attached at 26 to the trowel and extends along handle 16 to the worker who may tilt the trowel by the application of force to cord 24 sufficient to overcome the bias of spring 20 as needed and hold and maintain the desired angle for repeated smoothing passes if so needed.

As illustrated in the drawings, spring bias 20 is a coil spring attached to the trowel and the handle. However, the spring itself could be a leaf spring or a spiral spring wound around pivot 18 to bias the trowel into operative position. The tension in spring 20 which may be desired will be controlled by the stiffness of the grout and the length of the handle from hand held contact to the patching area. The stiffer the grout, the greater the desired tension so the trowel will push with adequate force. The same comments relate to the working length of the handle.

FIGS. 2 and 4 illustrate a plurality of attachment locations and any of those are within the inventive concept. The rigid connection illustrated in FIG. 3 will be explained subsequently.

It will be observed that there are two embodiments illustrated in FIGS. 1, 2 and 4. FIG. 1 at the top shows the trowel 14 at the lower end of the handle 16 and the grout 22 lowered from the roof through the top of the chimney to the proper operative location in preparation for filling and patching the hole 12. FIG. 1 at the lower end, on the other hand, shows the trowel 14 on the upper end of handle 16 where the grout 22 is again on the upper surface of the trowel but the trowel and handle are urged upwardly into operative position from below in the fire box 27 of the fireplace.

FIG. 1 at the lower end also illustrates an elbow 28 serving as a connecter between two angularly disposed pieces 30 and 32 to provide an offset for the handle 16 to accommodate offsets in the chimney construction. This allows the angular positioning of pieces at almost any angle up to 180°.

Where the pieces of handle are aligned in a linear path, the wooden pieces of the handle are connected by an internally threaded sleeve 34 configured to receive the externally threaded ends of handle pieces 30 and 32. The embodiments illustrated show the sleeve 34 as a swivel nut but, the connector could be a sleeve with internal threads at each end to receive externally threaded ends on pieces 30, 32.

In describing the process for patching holes 12 and 13 it will be understood that the holes may or may not be visible to the worker by direct line of sight, but if the break 12 is not visible by direct line of sight, the worker may resort to the use of an angularly oriented mirror on the lower end of a handle similar to handle 16, which mirror may be illuminated by a flashlight or the like from the location of the worker or the use of a video camera lens mounted to the tool and viewed by a monitor.

First a quantity of grout 22 is deposited on one end of the trowel 14 and on its upper surface. Then the trowel is moved to a position adjacent wall 10, physically below hole 12. The trowel may arrive at its position below break 12 by being raised from the fireplace as illustrated at the lower end of FIG. 1 or lowered from the top of the chimney by a worker standing on the roof as illustrated at the upper end of FIG. 1.

After the trowel is in position just below the break 12, the trowel is pushed into position in contact with the wall 10. Then the trowel is tilted simultaneously with movement of the handle (upward or downward, depending on whether it is the upper or lower section of FIG. 1) to tilt the upper side of the trowel which supports the grout. The direction of tilt is toward the hole, and then the grout is pushed into hole 12 by the trowel mashing the grout 22 as the trowel slides upward along the wall surface. This upward sliding movement pushes the grout into break 12 and smoothes its exposed surface. More than one application of grout may be necessary to completely fill and seal break 12, but the subsequent applications of grout are identical to the one described. In each case the tilting of the trowel toward the hole is accomplished either by pulling the cord 24 to overcome the bias of spring 20 to cause the tilting of the trowel or frictional engagement of the trowel edge with the masonry surface 10 may be adequate to cause the tilting.

The drawings illustrate the preferred trowel 14 embodiment as a multi-piece unit which includes a flexible plate 36 as the grout bearing-wall engaging portion. Plate 36 is secured to a wooden block 38 by a pair of screws 40 and wing nuts 42 which may slide longitudinally in slots 44 to adjust the flex of the grout spreader.

Figure 3:
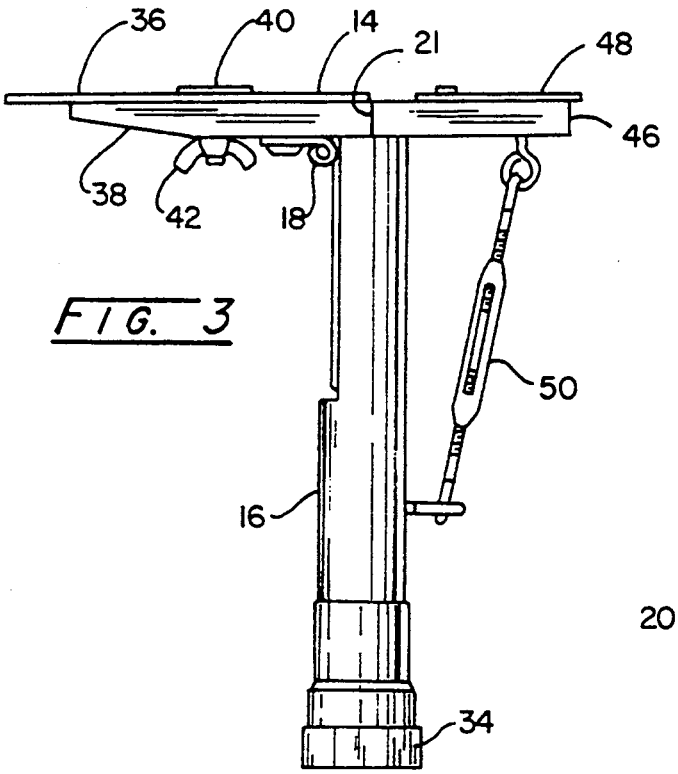
FIG. 3 is a side elevational view of the tool of this invention incorporating a rigid strut between the handle and the trowel section.

FIG. 3 shows a second block 46 secured to the top of handle 16 and secured to the top of block 46 is a thin tamping plate 48. Tamping plate 48 may be used to pack grout deeper into holes 12 and 13 after it has been applied by trowel 14 by merely reversing the tool by twirling the handle 16. Note that in the FIG. 3 embodiment the trowel engaging surface 21 is the vertical face of block 46. Also, block 46 is maintained in rigid position by a turn buckle 50 secured between the block 46 and handle 16.

Having thus described the apparatus and procedural steps for carrying out the invention, it will be clear to those having ordinary skill in the art, that various modifications may be made in the apparatus and the procedural steps without departing from the inventive concept. It is not intended that the words used in the specification to describe the invention, nor the drawings illustrating the same, be limiting on the invention. Rather it is intended that the invention be limited only by the scope of the appended claims.

I claim:

1. Apparatus for patching a break in a masonry wall, said wall being generally vertically disposed and said break being remote and beyond arm's length from the location of a user of the apparatus, comprising, an elongated handle having two opposite ends, at least a part of said handle extending generally vertically when in operative position, said handle having a trowel engaging surface at one of said ends and the other said end being engagable by the hands of the user, said trowel, engaging surface being stationary with respect to said handle, a trowel having a flat support surface to support break patching material, said trowel being pivotally attached to said handle adjacent the trowel engaging surface, means for biasing connected between at least part of said handle and said trowel, whereby said trowel is in engagement with said trowel engaging surface to a position where said flat trowel surface is generally perpendicular to at least a part of said handle.

means for pivoting said trowel from engagement with said trowel engaging surface to a position where said flat trowel surface is substantially parallel with at least a part of said handle said pivoting means comprising a manually operable connecting link extending from a portion of said trowel to near the hand engageable end of said handle.

2. The apparatus of claim 1 wherein said connecting link comprises a flexible cord attached to said trowel at a position remote from said handle

3. The apparatus of claim 2 wherein said handle comprises a plurality of pieces threadedly connected together.

4. The apparatus of claim 3 including an angularly extending elbow connecting two of said handle pieces, the lineal axes of said two connected pieces defining an angle of less than 180°.

5. The apparatus of claim 1 wherein said handle comprises a plurality of pieces threadedly connected together.

6. The apparatus of claim 5 including an angularly extending elbow connecting two of said handle pieces, the lineal axis of said two connected pieces defining an angle of less than 180°.

* * * * *